US011692333B2

(12) United States Patent
Lee

(10) Patent No.: US 11,692,333 B2
(45) Date of Patent: Jul. 4, 2023

(54) CONSTRUCTION MACHINE TRAVELING CONTROL SYSTEM

(71) Applicant: VOLVO CONSTRUCTION EQUIPMENT AB, Eskilstuna (SE)

(72) Inventor: Sanghee Lee, Gimhae-si (KR)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 938 days.

(21) Appl. No.: 16/342,702

(22) PCT Filed: Oct. 20, 2016

(86) PCT No.: PCT/KR2016/011812

§ 371 (c)(1),
(2) Date: Jul. 26, 2019

(87) PCT Pub. No.: WO2018/074629

PCT Pub. Date: Apr. 26, 2018

(65) Prior Publication Data

US 2019/0345693 A1 Nov. 14, 2019

(51) Int. Cl.
*B62D 11/04* (2006.01)
*B60K 6/08* (2006.01)
(Continued)

(52) U.S. Cl.
CPC ..... *E02F 9/225* (2013.01); *E02F 9/2004* (2013.01); *E02F 9/2264* (2013.01); *E02F 9/2278* (2013.01)

(58) Field of Classification Search
CPC ..... E02F 9/225; E02F 9/2004; E02F 9/2264; E02F 9/2278; E02F 9/2253; E02F 9/2012;
(Continued)

(56) References Cited

U.S. PATENT DOCUMENTS 3,357,509 A * 12/1967 Gustafsson et al. ..... C08G 59/3245 475/23
3,774,707 A * 11/1973 Bridwell ..... F15B 13/0402 180/6.48
(Continued)

FOREIGN PATENT DOCUMENTS

CN 105026654 A 11/2015
CN 105934550 A 9/2016
(Continued)

OTHER PUBLICATIONS

International Search Report and Written Opinion of the International Searching Authority, PCT/KR2016/011812, dated Jul. 3, 2017, 11 pages.

*Primary Examiner* — Edwin J Toledo-Duran
(74) *Attorney, Agent, or Firm* — Sage Patent Group

(57) ABSTRACT

A construction machine traveling control system is provided. The construction machine traveling control system includes first and second electric traveling pedals for outputting manipulation values including electric signals in response to the driver's manipulation and thereby operating first and second traveling motors connected thereto, respectively; a traveling pattern input means installed in the driving room so as to enable the driver to input a construction machine traveling pattern; a controller electrically connected to the first and second electric traveling pedals and to the traveling pattern input means; and a hydraulic circuit electrically connected to the controller so as to control the flow rate of operation oil supplied to the first and second traveling motors, as well as the flow of the operation oil, according to the command values delivered from the controller.

10 Claims, 5 Drawing Sheets

(51) Int. Cl.
*E02F 9/22* (2006.01)
*E02F 9/20* (2006.01)

(58) Field of Classification Search
CPC ..... E02F 3/962; E02F 9/123; E02F 3/4135; B62D 11/005; B62D 11/04; B62D 11/001; B60K 31/00; B60K 6/12; B60K 6/08; B60K 2031/0091; Y02T 10/62
See application file for complete search history.

(56) References Cited

U.S. PATENT DOCUMENTS 3,990,527 A * 11/1976 Inui ..... B62D 11/183 180/6.66
4,163,413 A * 8/1979 Kennicutt ..... B62D 11/183 91/522
4,400,997 A * 8/1983 Fiala ..... B60W 20/40 74/661
4,457,387 A * 7/1984 Taylor ..... B62D 11/183 60/484
4,841,841 A * 6/1989 Redelman ..... B62D 11/183 91/375 R
4,951,766 A * 8/1990 Basedow ..... A61G 5/045 180/907
5,002,454 A * 3/1991 Hadank ..... E02F 9/2025 74/471 XY
5,285,861 A * 2/1994 Nakamura ..... B62D 11/183 180/6.7
5,482,138 A * 1/1996 Mori ..... F16N 29/02 184/6
5,860,484 A * 1/1999 Kauss ..... B62D 11/183 60/443
5,934,397 A * 8/1999 Schaper ..... B62D 63/025 180/65.245
6,148,939 A * 11/2000 Brookhart ..... B62D 11/183 180/6.48
6,276,134 B1 * 8/2001 Matsuyama ..... F16H 61/444 91/506
6,684,969 B1 * 2/2004 Flowers ..... A61G 5/128 180/316
8,251,162 B2 * 8/2012 Kim ..... B62D 11/005 180/6.48
8,985,263 B2 * 3/2015 Peterson ..... B60N 2/4242 180/317
9,132,855 B2 * 9/2015 Bertsch ..... E02F 9/2012
9,604,668 B2 * 3/2017 Storey ..... B60K 31/00
9,840,140 B1 * 12/2017 Holmes ..... B60K 6/387
10,774,504 B2 * 9/2020 Storey ..... E02F 9/2012
2001/0011050 A1 * 8/2001 Yamaguchi ..... H02K 7/108 477/3
2002/0024306 A1 * 2/2002 Imai ..... B60K 6/442 903/910
2004/0134698 A1 * 7/2004 Yamamoto ..... B60W 20/40 180/65.225
2006/0105876 A1 * 5/2006 Holmes ..... B60K 6/48 475/5
2008/0119985 A1 * 5/2008 Schubitzke ..... B62D 11/001 701/41
2008/0182698 A1 * 7/2008 Matsubara ..... B60W 30/19 475/151
2008/0208422 A1 * 8/2008 Shibata ..... B60W 10/06 701/54
2008/0243322 A1 * 10/2008 Nobumoto ..... B60W 10/02 701/22
2008/0255748 A1 * 10/2008 Kumazaki ..... B60W 10/08 701/102
2009/0088291 A1 * 4/2009 Kumazaki ..... B60W 20/40 903/945
2009/0143950 A1 * 6/2009 Hasegawa ..... B60W 30/186 701/68
2009/0198414 A1 * 8/2009 Mohning ..... B62D 1/12 280/93.5
2010/0099532 A1 * 4/2010 Cashen ..... B60W 30/18127 180/65.265
2011/0120785 A1 * 5/2011 Kim ..... B62D 11/04 180/6.48
2013/0218394 A1 * 8/2013 Kanayama ..... B60W 10/02 180/65.23
2013/0226387 A1 * 8/2013 Hayashi ..... B60W 50/06 180/65.23
2013/0253743 A1 * 9/2013 Maruyama ..... B60W 20/40 180/65.265
2014/0129067 A1 * 5/2014 Furukawa ..... B60W 10/06 903/945
2014/0208934 A1 * 7/2014 Raszga ..... F16H 61/421 91/471
2014/0243149 A1 * 8/2014 Holmes ..... B60W 20/20 180/65.265
2014/0343780 A1 * 11/2014 Suzuki ..... B60W 30/18127 701/22
2016/0009316 A1 * 1/2016 Storey ..... E02F 3/962 180/170
2016/0024754 A1 * 1/2016 Miyamoto ..... B60W 20/10 903/902
2016/0083930 A1 * 3/2016 Monden ..... B60W 10/10 701/50
2016/0083931 A1 * 3/2016 Monden ..... B60L 7/26 701/50
2016/0121722 A1 * 5/2016 Roberts ..... B60K 26/02 180/242
2016/0160470 A1 * 6/2016 Kishimoto ..... B60K 6/365 903/910
2016/0288780 A1 * 10/2016 Shukla ..... B60W 30/19
2016/0362102 A1 * 12/2016 Honda ..... B60W 10/20
2017/0282702 A1 * 10/2017 Kim ..... B60K 6/40
2017/0370446 A1 * 12/2017 Steinberger ..... F16H 3/727
2019/0077479 A1 * 3/2019 Chen ..... B62K 11/007
2019/0135103 A1 * 5/2019 Kuze ..... B60K 6/543
2020/0102719 A1 * 4/2020 Oasa ..... F16H 61/4043
2020/0123740 A1 * 4/2020 Oasa ..... F16H 61/435
2020/0158235 A1 * 5/2020 Oasa ..... E02F 9/2267
2020/0199850 A1 * 6/2020 Oasa ..... F16H 61/425
2021/0010240 A1 * 1/2021 Shoemaker ..... B62D 11/04
2021/0070266 A1 * 3/2021 Tabata ..... B60K 6/547
2022/0324425 A1 * 10/2022 Kim ..... B60T 17/221

FOREIGN PATENT DOCUMENTS

JP 2006-306199 A 11/2006
JP 4386265 B2 12/2009
KR 10-2011-0055998 A 5/2011
KR 10-1157267 B1 7/2012
KR 10-1648979 B1 8/2016
WO WO 2015/111779 A1 7/2015

* cited by examiner

CONSTRUCTION MACHINE TRAVELING CONTROL SYSTEM

CROSS REFERENCE TO RELATED APPLICATIONS

This application is a 35 U.S.C. § 371 national stage application of PCT Application No. PCT/KR2016/011812 filed on Oct. 20, 2016, the disclosure and content of which are incorporated by reference herein in its entirety.

TECHNICAL FIELD

The present invention relates to a traveling control system for a construction machine and, more particularly, to a traveling control system for a construction machine capable of easily and rapidly changing diverse traveling patterns desired by a driver in connection with a construction machine equipped with electric traveling pedals, such as an excavator.

BACKGROUND ART

In general, two traveling pedals are used for excavator traveling. In this case, one traveling pedal is used to control a left traveling motor and the other traveling pedal is used to control a right traveling motor. For forward or backward traveling, the two traveling pedals are manipulated forward or backward at the same time. However, the simultaneous manipulation on the two traveling pedals for forward or backward movement causes inconvenience to the driver. In particular, when the two traveling pedals are not manipulated by the same amount, the excavator turns left or right, instead of moving forward or backward. Therefore, an additional pedal referred to as a straight traveling pedal is usually equipped and used.

FIG. 7 is a circuit diagram depicting a hydraulic system for excavator traveling in accordance with the related art.

As shown in FIG. 7, the hydraulic system for excavator traveling in accordance with the related art includes a first hydraulic traveling pedal 1*a*, a second hydraulic traveling pedal 1*b*, a hydraulic straight traveling pedal 2, a left traveling motor 3, a right traveling motor 4, shuttle valves 5*a* to 5*d* and a main control valve 8. Here, the first hydraulic traveling pedal 1*a* is configured to control the left traveling motor 3, and the second hydraulic traveling pedal 1*b* is configured to control the right traveling motor 4. Also, the hydraulic straight traveling pedal 2 is configured to control forward and backward traveling. The shuttle valves 5*a* to 5*d* are configured to select a signal having a larger value from signals to be applied from the first hydraulic traveling pedal 1*a* and the second hydraulic traveling pedal 1*b* and a signal to be applied from the hydraulic straight traveling pedal 2 and to transmit the same to traveling spools 6, 7 of the main control valve 8.

Operations of the hydraulic system for excavator traveling in accordance with the related art are described. A pilot signal pressure applied from the first hydraulic traveling pedal 1*a* switches the traveling spool 6 via the shuttle valve 5*a* through a pilot line 9. Thereby, operating oil discharged from a hydraulic pump P1 is supplied to the left traveling motor 3 via the traveling spool 6, so that the left traveling motor 3 is driven. A method of driving the right traveling motor 4 is also the same.

Here, in order to move forward or backward the excavator, the first hydraulic traveling pedal 1*a* and the second hydraulic traveling pedal 1*b* have only to be manipulated in the same direction at the same time. However, the simultaneous manipulation on the first hydraulic traveling pedal 1*a* and the second hydraulic traveling pedal 1*b* causes inconvenience to the driver. In particular, when manipulation amounts on the first hydraulic traveling pedal 1*a* and the second hydraulic traveling pedal 1*b* are not the same, the pilot signal pressures to be transmitted to the respective traveling spools 6, 7 are different, so that the excavator travels obliquely leftward or rightward, unlike the driver's intention. In order to prevent this problem, the excavator of the related art is equipped with the hydraulic straight traveling pedal 2. A pilot signal pressure that is generated when manipulating the hydraulic straight traveling pedal 2 passes one shuttle valve 5*a* and the other shuttle valve 5*b* through a pilot line 10, so that the respective traveling spools 6, 7 are switched at the same time with the same pilot signal pressure. Then, the operating oil discharged from the hydraulic pumps P1, P2 is supplied to each of the left traveling motor 3 and the right traveling motor 4. In this way, the excavator can move forward or backward.

Like this, according to the related art, it is possible to securely move forward or backward the excavator only when the additional straight traveling pedal 2 is equipped. However, the cost of the equipment increases, and the hydraulic circuit for actuation becomes complicated, so that a quality problem such as oil leakage may also be caused.

SUMMARY OF INVENTION

Technical Problem

The present invention has been made in view of the above situations, and an object thereof is to provide a traveling control system for a construction machine capable of easily and rapidly changing diverse traveling patterns desired by a driver in connection with a construction machine equipped with electric traveling pedals, such as an excavator.

Solution to Problem

In order to achieve the above object, according to the present invention, there is provided a traveling control system for a construction machine including first and second electric traveling pedals configured to output manipulation values of electric signals in response to driver's manipulation and to thereby operate first and second traveling motors connected thereto, respectively; a traveling pattern input means equipped in an operator's cab so as to enable a driver to input a traveling pattern of the construction machine; a controller electrically connected to the first and second electric traveling pedals and the traveling pattern input means, and configured to sense the manipulation value to be output from at least one of the first and second electric traveling pedals and the traveling pattern to be input to the traveling pattern input means and to calculate and output command values required for operations of the first and second traveling motors in accordance with the input traveling pattern, and a hydraulic circuit electrically connected to the controller and configured to control a flow rate and flow of operating oil to be supplied to the first and second traveling motors in accordance with the command values to be transmitted from the controller, thereby driving the first and second traveling motors.

The controller may include a memory unit in which a plurality of setting traveling patterns is to be stored, a sensing unit configured to sense the manipulation values and the traveling pattern, and a calculation unit configured to compare the sensed traveling pattern and the plurality of setting traveling patterns and to calculate the command values to be output to the hydraulic circuit in accordance with the sensed manipulation values so that the first and second traveling motors are to he operated in accordance with a setting traveling pattern, which coincides with the sensed traveling pattern, of the plurality of setting traveling patterns.

Also, the traveling pattern may include a first traveling pattern for moving forward or backward the construction machine in accordance with manipulation on the first electric traveling pedal and turning left or right the construction machine in accordance with manipulation on the second electric traveling pedal.

When the controller senses the first traveling pattern input to the traveling pattern input means and the manipulation value output from the first electric traveling pedal, the controller may calculate a first command value required for the operation of the first traveling motor and a second command value required for the operation of the second traveling motor and transmit the same to the hydraulic circuit, thereby moving forward or backward the construction machine.

Also, when the controller senses the first traveling pattern input to the traveling pattern input means and the manipulation value output from the second electric traveling pedal, the controller may calculate a third command value required for the operation of the first traveling motor and a fourth command value required for the operation of the second traveling motor and transmit the same to the hydraulic circuit, thereby turning left or right the construction machine.

When the controller senses the first traveling pattern input to the traveling pattern input means and the manipulation values output from each of the first and second electric traveling pedals, the controller may calculate a fifth command value required for the operation of the first traveling motor and a sixth command value required for the operation of the second traveling motor and transmit the same to the hydraulic circuit, thereby turning left or right the construction machine, a relative turning speed thereof being increased or decreased as compared to the left turn or right turn of the construction machine in accordance with the third command value and the fourth command value.

The fifth command value may be a sum of the first command value and the third command value.

Also, when the sum of the first command value and the third command value is a positive value, the first traveling motor may rotate in a forward direction, and when the sum is a negative value, the first traveling motor may rotate in a reverse direction.

An electric signal having a magnitude corresponding to an absolute value of the fifth command value may be transmitted from the controller to the hydraulic circuit.

As the sixth command value, a relatively larger command value of the second command value and the fourth command value may be selected.

Advantageous Effects of Invention

According to the present invention, the traveling pattern input means for enabling the driver to select the traveling pattern of the construction machine, such as an excavator and the controller configured to calculate and output the command values required for operations of the traveling motors in accordance with the traveling pattern input from the traveling pattern input means are provided. Therefore, it is possible to easily and rapidly change the diverse traveling patterns desired by the driver in connection with the excavator. In particular, it is possible to move forward or backward the excavator with only one traveling pedal, so that it is possible to increase driver's convenience and to secure traveling stability.

Also, according to the present invention, it is not necessary to provide a separate straight traveling pedal, unlike the related art, so that it is possible to suppress the additional cost increase of the construction machine.

DESCRIPTION OF EMBODIMENTS

Hereinafter, a traveling control system for a construction machine in accordance with an embodiment of the present invention will be described in detail with reference to the accompanying drawings.

When describing the present invention, the specific descriptions of the related well-known functions or configurations will be omitted if it is considered that the descriptions make the gist of the present invention unclear.

Figure 1:
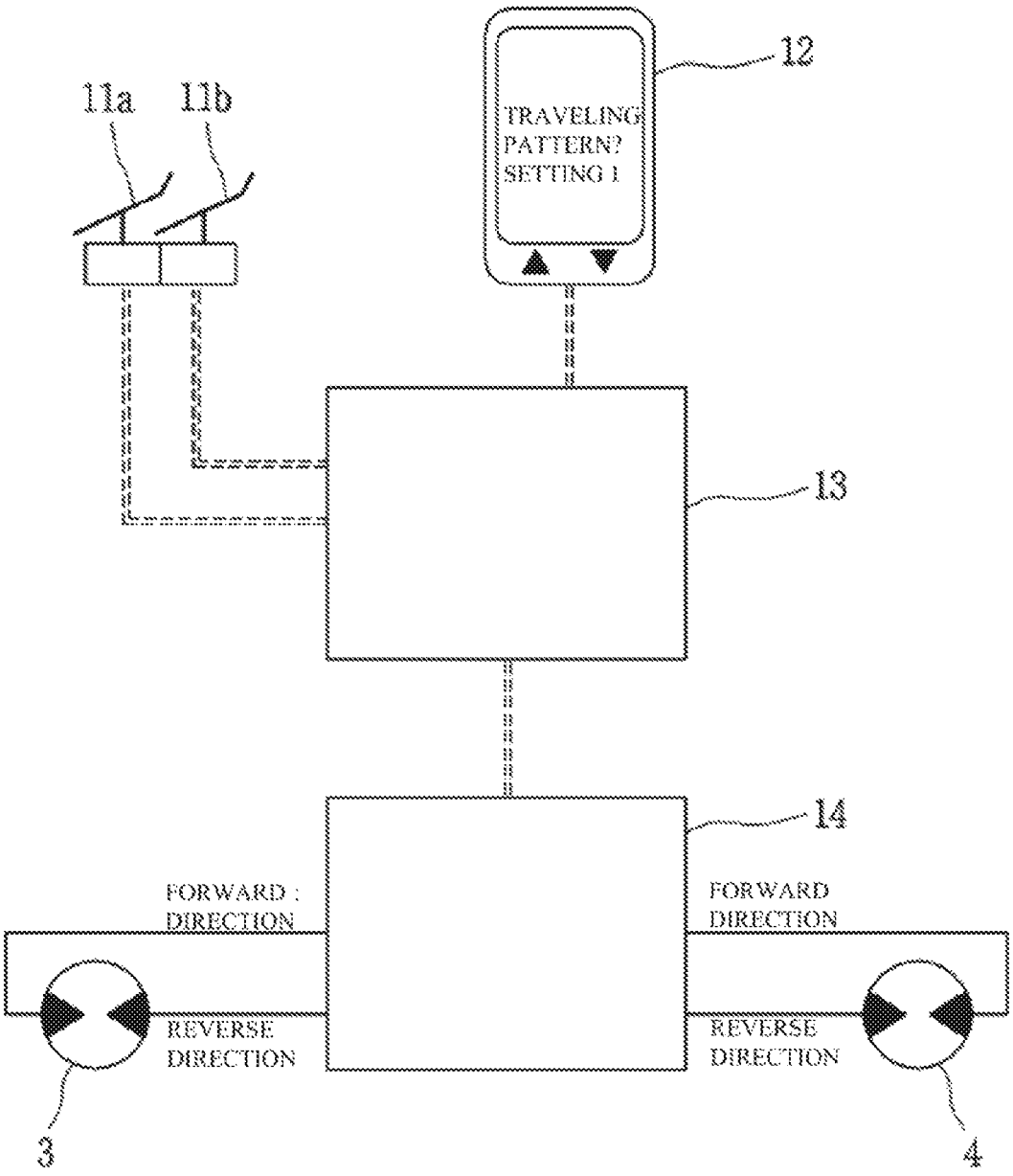
FIG. 1 is a schematic configuration view depicting a traveling control system for a construction machine in accordance with an embodiment of the present invention.

A traveling control system for a construction machine in accordance with an embodiment of the present invention is a system for controlling traveling such as forward movement, backward movement, left turn and right turn of a construction machine, for example, an excavator. As shown in FIG. 1, the traveling control system for a construction machine in accordance with the embodiment of the present invention includes a first electric traveling pedal 11*a*, a second electric traveling pedal 11*b*, a traveling pattern input means 12, a controller 13 and a hydraulic circuit 14.

The first electric traveling pedal 11*a* is configured to output a manipulation value of an electric signal in response to driver's manipulation and to thereby operate a first traveling motor 3 connected thereto. For example, when the first electric traveling pedal 11*a* is manipulated forward (on the basis of a posture of the driver sitting on a front driver seat) by the driver, the first traveling motor 3 rotates in a forward direction, and when the first electric traveling pedal 11*a* is manipulated backward, the first traveling motor 3 rotates in a reverse direction. Here, the first traveling motor 3 is configured to be substantially driven by operating oil that is to be supplied from the hydraulic circuit 14 in accordance with the manipulation on the first electric traveling pedal 11*a*. The first traveling motor 3 may be a track motor configured to drive a crawler type track mounted on a lower traveling structure of an excavator, for example.

The second electric traveling pedal 11*b* is configured to output a manipulation value of an electric signal in response to driver's manipulation and to thereby operate a second traveling motor 4 connected thereto. The second electric traveling pedal 11*b* is configured to control the second traveling motor 4 in the same manner as the first electric traveling pedal 11*a*. That is, when the second electric traveling pedal 11*b* is manipulated forward by the driver, the second traveling motor 4 rotates in a forward direction, and when the second electric traveling pedal 11*b* is manipulated backward, the second traveling motor 4 rotates in a reverse direction. Like the first traveling motor 3, the second traveling motor 4 is configured to be driven by operating oil that is to be supplied from the hydraulic circuit 14 in accordance with the manipulation on the second electric traveling pedal 11*b*, and may be a track motor.

The traveling pattern input means 12 is equipped in an operator's cab. In this case, the traveling pattern input means 12 is preferably equipped at a position at which the driver sitting on the driver seat can perform manipulation with sitting on the driver seat. The traveling pattern input means 12 is configured to enable the driver to input a traveling pattern of the excavator. That is, the traveling pattern input means 12 is configured to enable the driver to select a traveling pattern of the excavator. When the driver selects a desired traveling pattern with the traveling pattern input means 12, an electric signal relating to the traveling pattern is transmitted to the controller 13 electrically connected to the traveling pattern input means 12.

TABLE 1

| Manipulation direction | First traveling pattern | Second traveling pattern | Third traveling pattern |
|---|---|---|---|
| First electric traveling pedal: forward | Excavator: forward movement | Excavator: right turn | First traveling motor: forward direction |
| First electric traveling pedal: backward | Excavator: backward movement | Excavator: left turn | First traveling motor: reverse direction |
| Second electric traveling pedal: forward | Excavator: left turn | Excavator: forward movement | Second traveling motor: forward direction |
| Second electric traveling pedal: backward | Excavator: right turn | Excavator: backward movement | Second traveling motor: reverse direction |

Table 1 shows traveling patterns that can be selected by the driver. As shown in Table 1, the first traveling pattern is a traveling pattern for moving forward or backward the excavator in accordance with the manipulation on the first electric traveling pedal 11*a* and turning left or right the excavator in accordance with the manipulation on the second electric traveling pedal 11*b*. Also, the second traveling pattern is a traveling pattern for turning left or right the excavator in accordance with the manipulation on the first electric traveling pedal 11*a* and moving forward or backward the excavator in accordance with the manipulation on the second electric traveling pedal 11*b*. That is, since the manipulation manners of the first electric traveling pedal 11*a* and the second electric traveling pedal 11*b* are determined depending on the traveling pattern, when there are the manipulation manners of the first electric traveling pedal 11*a* and the second electric traveling pedal 11*b* desired by the driver, the driver can select the corresponding traveling pattern. As can be seen from the first traveling pattern and the second traveling pattern in Table 1, the excavator can be moved forward or backward with only one of the first electric traveling pedal 11*a* and the second electric traveling pedal 11*b*. Therefore, it is possible to increase driver's convenience and to more stably move forward or backward the excavator. Like this, the change in manipulation manner based on the traveling pattern selected by the driver and the corresponding operations of the first traveling motor 3 and the second traveling motor 4 are controlled by the controller 13, which will be described later in more detail.

In the meantime, as shown in Table 1, the traveling pattern may further include the third traveling pattern. The third traveling pattern is a traveling pattern for rotating the first traveling motor 3 in the forward or reverse direction in accordance with the manipulation on the first electric traveling pedal 11*a* and rotating the second traveling motor 4 in the forward or reverse direction in accordance with the manipulation on the second electric traveling pedal 11*b*. The traveling pattern may further include diverse traveling patterns so as to widen the options to be selected by the driver, in addition to the first to third traveling patterns.

The traveling pattern input means 12 may have a display window so that the driver can select the traveling pattern. In this case, as shown in FIG. 1, the first to third traveling patterns may be displayed as "setting 1", "setting 2" and "setting 3" on the display window of the traveling pattern input means 12. The display window may be configured by a touch panel so that icons relating to the traveling patterns displayed in this way can be touched and selected by the driver. Also, the traveling pattern input means 12 may be provided with an icon selection button. In this case, the driver can select a desired traveling pattern by manipulating the icon selection button.

Figure 7:
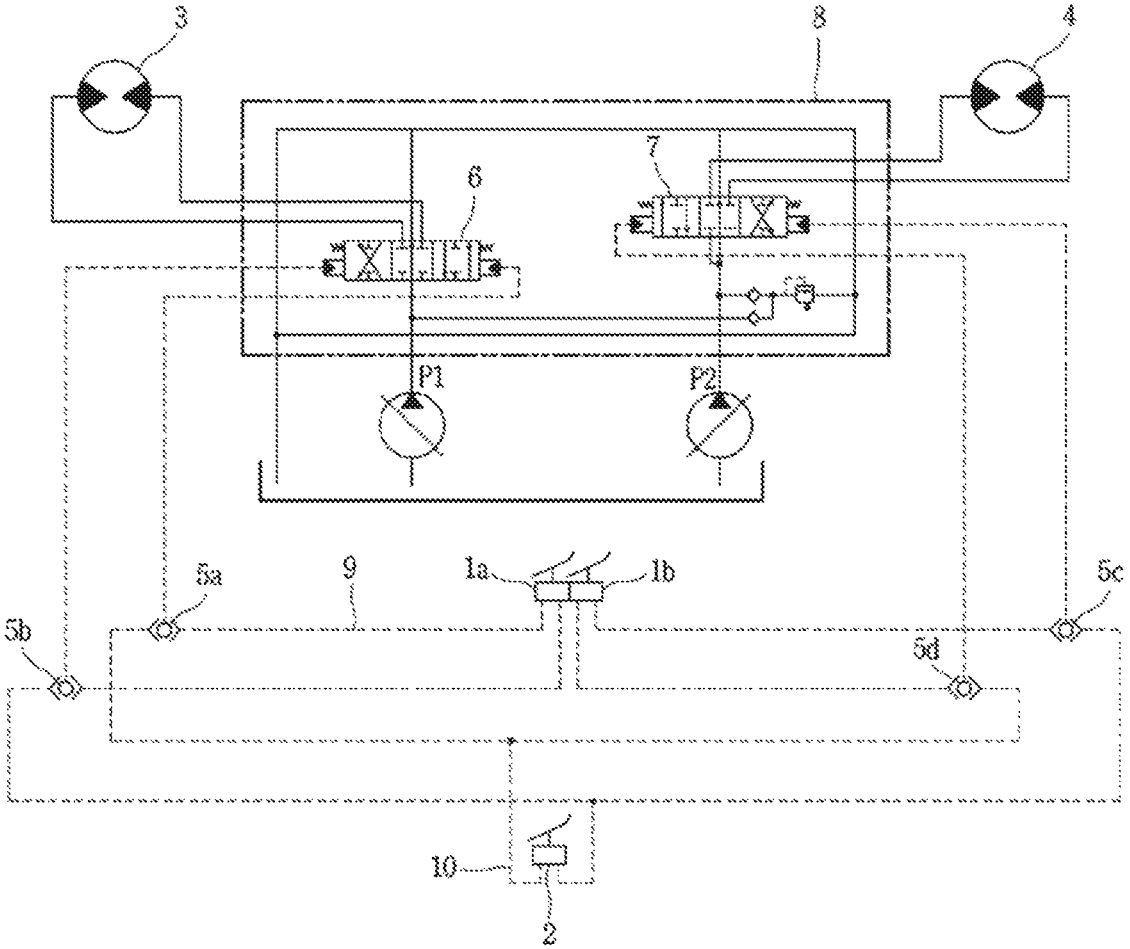
FIG. 7 is a circuit diagram depicting a hydraulic system for excavator traveling in accordance with the related art.

The controller 13 is electrically connected to the first electric traveling pedal 11*a*, the second electric traveling pedal 11*b* and the traveling pattern input means 12. The controller 13 is configured to sense a manipulation value that is to be output from at least one of the first electric traveling pedal 11*a* and the second electric traveling pedal 11*b*. Also, the controller 13 is configured to sense a traveling pattern that is to be input to the traveling pattern input means 12 by the driver. The controller 13 is configured to calculate command values required for operations of the first traveling motor 3 and the second traveling motor 4 in accordance with the input traveling pattern and to output the same to the hydraulic circuit 14 electrically connected thereto. In the embodiment of the present invention, the command values are defined as magnitudes of electric signals for determining degrees of switching of the traveling spools 6, 7 (refer to FIG. 7) provided to the hydraulic circuit 14.

Figure 2:
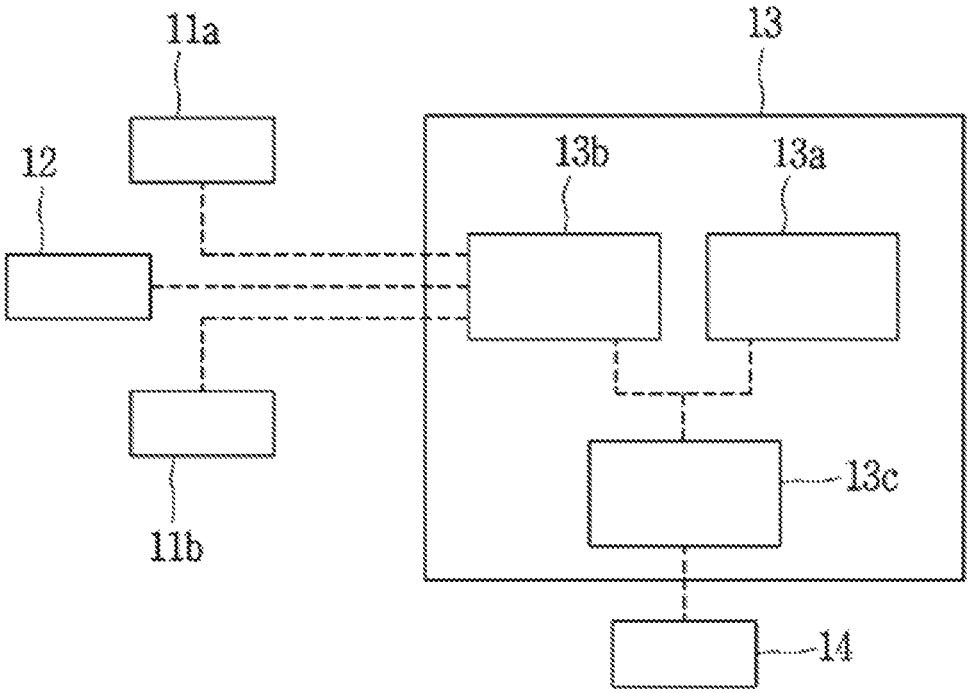
FIG. 2 is a configuration view depicting a controller of the traveling control system for a construction machine in accordance with the embodiment of the present invention.

To this end, as shown in FIG. 2, according to the embodiment of the present invention, the controller 13 may include a memory unit 13*a*, a sensing unit 13*b* and a calculation unit 13*c*.

In the memory unit 13*a*, a plurality of setting traveling patterns is stored. Here, the plurality of setting traveling patterns is the first to third traveling patterns as shown in Table 1. The setting traveling patterns stored in the memory unit 13*a* are displayed on the display window of traveling pattern input means 12 so that the driver can select the same.

The sensing unit 13*b* is configured to sense the manipulation values that are to be output from the first electric traveling pedal 11*a* and the second electric traveling pedal 11*b* and are to be transmitted as electric signals. Also, the sensing unit 13*b* is configured to sense a traveling pattern that is to be selected and input to the traveling pattern input means 12 by the driver and is to be transmitted as an electric signal by the traveling pattern input means 12.

The calculation unit 13*c* is configured to compare the traveling pattern sensed by the sensing unit 13*b* and the plurality of setting traveling patterns stored in the memory unit 13*a*, to select a setting traveling pattern, which coincides with the sensed traveling pattern, of the plurality of setting traveling patterns, and to calculate the command values, i.e., the command values required for operations of the first traveling motor 3 and the second traveling motor 4 to be output to the hydraulic circuit 14 in accordance with the manipulation values of the first electric traveling pedal 11*a* and the second electric traveling pedal 11*b* sensed by the sensing unit 13*b* so that the first traveling motor 3 and the second traveling motor 4 are to be operated in accordance with the selected setting traveling pattern.

The hydraulic circuit 14 is electrically connected to the controller 13. Thereby, the hydraulic circuit 14 is configured to control a flow rate and flow of operating oil to be supplied to the first traveling motor 3 and the second traveling motor 4 in accordance with the command values transmitted from the controller 13, thereby driving the first traveling motor 3 and the second traveling motor 4. Here, since the hydraulic circuit 14 has the same configuration and operation as the main control valve 8 configured to control a flow rate and flow of the operating oil that is to be discharged from the hydraulic pumps P1, P2 shown in FIG. 7 and is to be supplied to the left and right traveling motors 3, 4, the detailed description thereof is omitted.

In the below, the control method of the controller that is to be executed when the first traveling pattern is selected by the driver is described with reference to FIGS. 3 to 6. The reference numerals of the respective configurations are denoted as shown in FIGS. 1 and 2.

In Examples of the present invention, the first traveling pattern is a traveling pattern for moving forward or backward the excavator in accordance with the manipulation on the first electric traveling pedal 11*a* and turning left or right the excavator in accordance with the manipulation on the second electric traveling pedal 11*b*.

EXAMPLE 1

Figure 3:
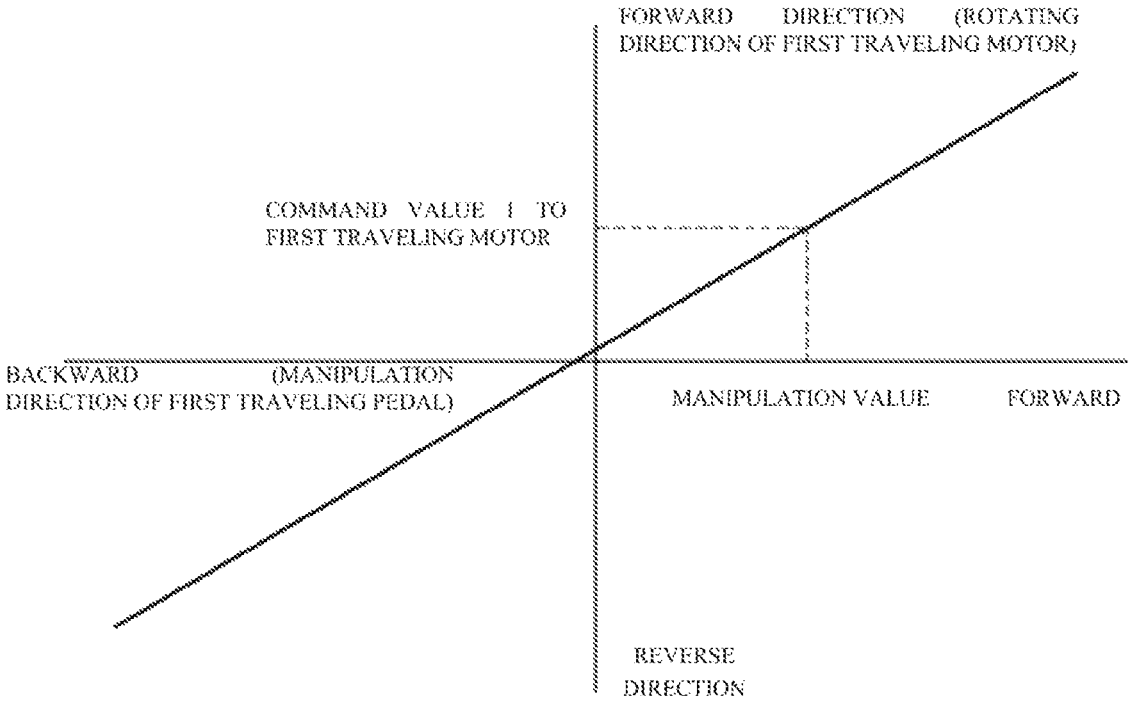
FIGS. 3 to 6 are graphs showing command values required for operations of traveling motors in accordance with manipulation values of electric traveling pedals.
Figure 4:
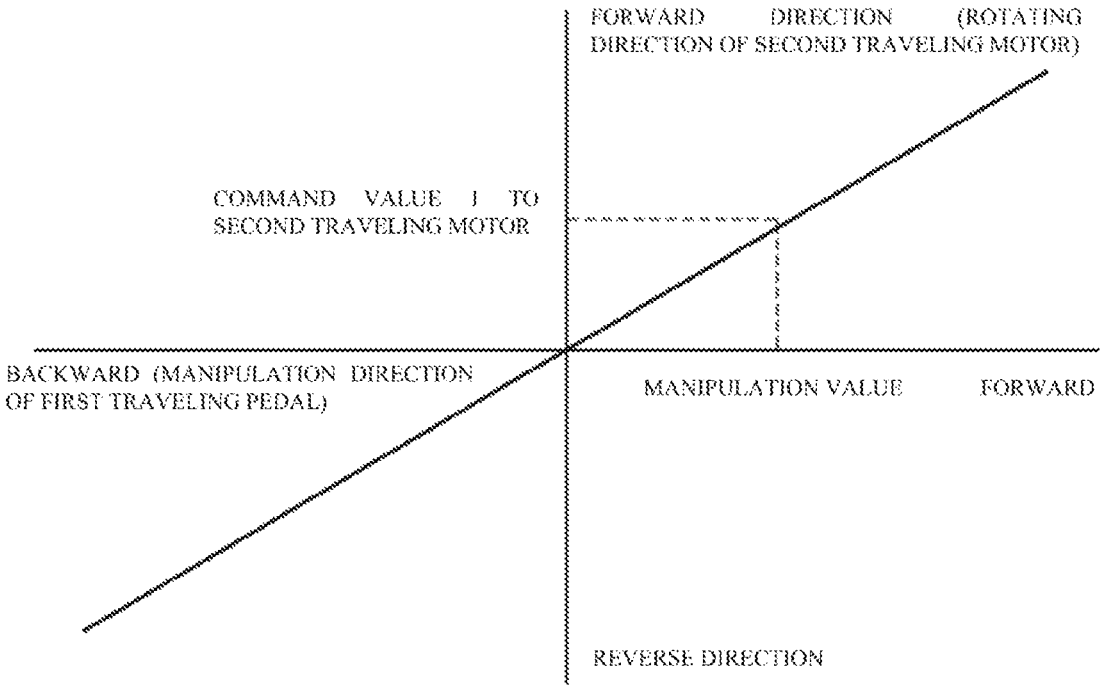

When the controller 13 senses the first traveling pattern input to the traveling pattern input means 12 by the driver and the manipulation value output as the first electric traveling pedal 11*a* is manipulated forward, the controller 13 calculates a first command value (a command value 1 to be input to the first traveling motor, in FIG. 3) required for operation of the first traveling motor 3, as shown in FIG. 3. Also, the controller 13 calculates a second command value (a command value 1 to be input to the second traveling motor, in FIG. 4) required for operation of the second traveling motor 4, as shown in FIG. 4. Then, the controller 13 transmits the first command value and the second command value to the hydraulic circuit 14 so as to operate the first traveling motor 3 and the second traveling motor 4. In this case, since the first traveling motor 3 and the second traveling motor 4 are all rotated in the forward direction and the manipulation on the second electric traveling pedal 11*b* has not been sensed, the excavator is moved forward. On the contrary, when the first electric traveling pedal 11*a* is manipulated backward, the excavator is moved backward through the series of controls of the controller 13 as described above.

EXAMPLE 2

Figure 5:
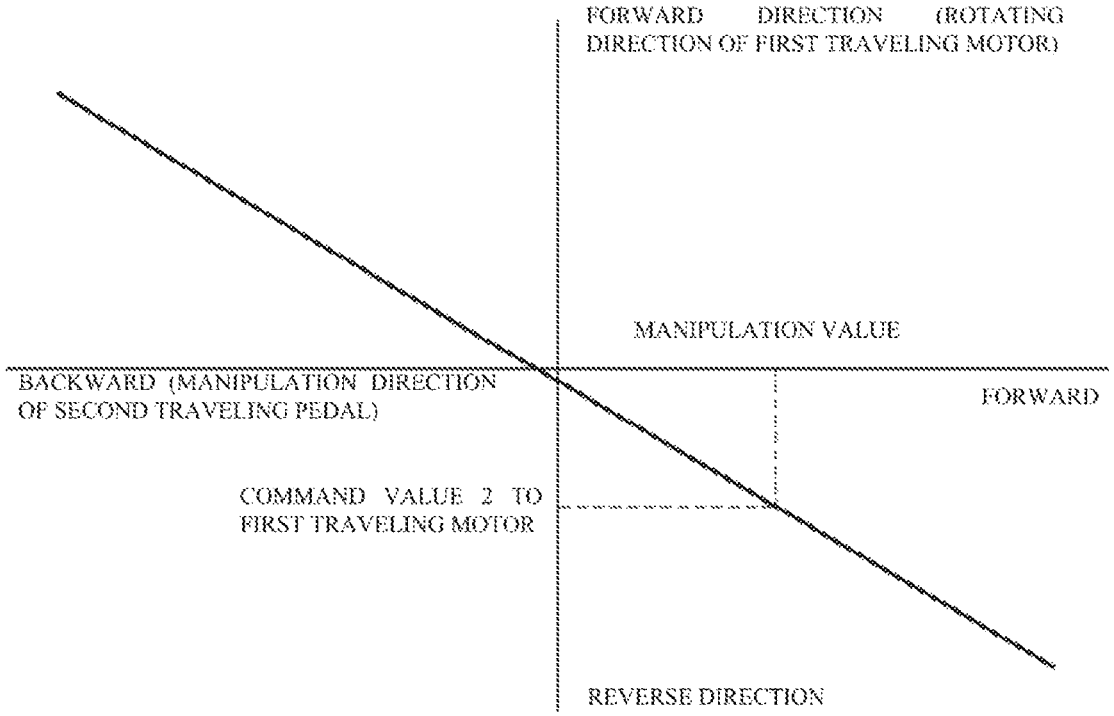
Figure 6:
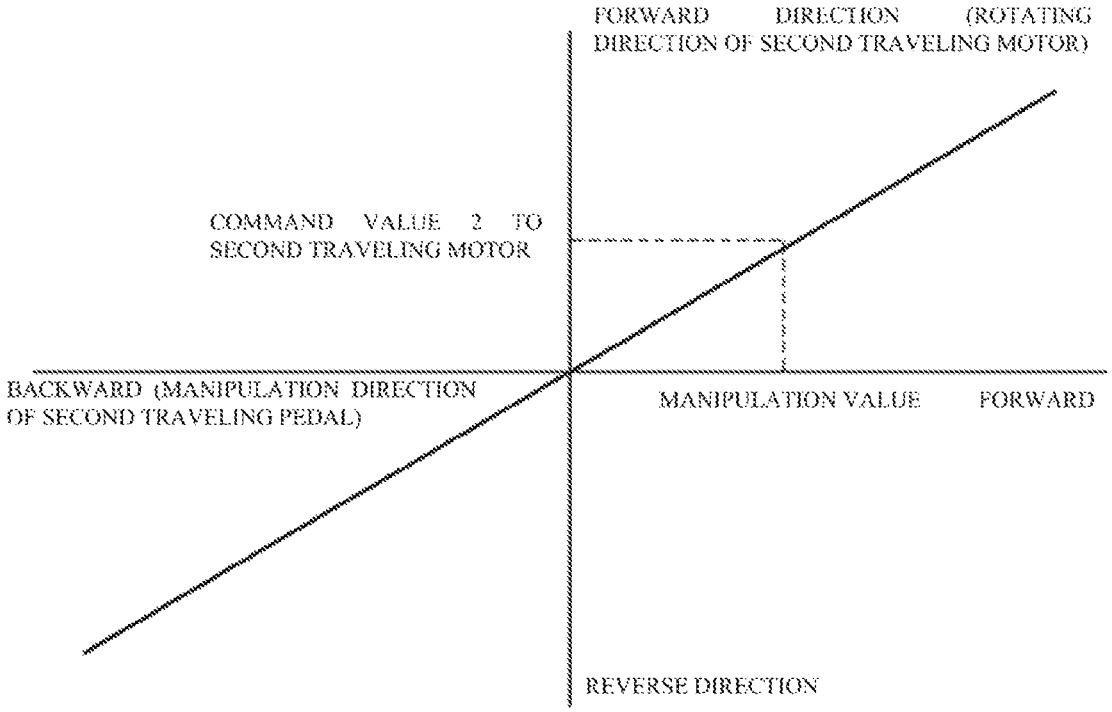

When the controller 13 senses the first traveling pattern input to the traveling pattern input means 12 by the driver and the manipulation value output as the second electric traveling pedal 11*b* is manipulated backward, the controller 13 calculates a third command value (a command value 2 to be input to the first traveling motor, in FIG. 5) required for operation of the first traveling motor 3, as shown in FIG. 5. Also, the controller 13 calculates a fourth command value (a command value 2 to be input to the second traveling motor, in FIG. 6) required for operation of the second traveling motor 4, as shown in FIG. 6. Then, the controller 13 transmits the third command value and the fourth command value to the hydraulic circuit 14 so as to operate the first traveling motor 3 and the second traveling motor 4. In this case, the first traveling motor 3 is rotated in the reverse direction and the second traveling motor 4 is rotated in the forward direction. By the rotations of the first traveling motor 3 and the second traveling motor 4, the excavator is turned left. On the contrary, when the second electric traveling pedal 11*b* is manipulated backward, the excavator is turned right through the series of controls of the controller 13 as described above.

Example 3

When the controller 13 senses the first traveling pattern input to the traveling pattern input means 12 by the driver and the respective manipulation values output as a result of the simultaneous manipulation on the first electric traveling pedal 11*a* and the second electric traveling pedal 11*b*, the controller 13 calculates a fifth command value required for operation of the first traveling motor 3. Here, the controller 13 calculates the fifth command value as a sum of the first command value and the third command value. In this case, when the fifth command value calculated as a sum of the first command value and the third command value is a positive value, the first traveling motor 3 is rotated in the forward direction, and when the fifth command value is a negative value, the first traveling motor 3 is rotated in the reverse direction. At this time, an electric signal having a magnitude corresponding to an absolute value of the fifth command value is transmitted from the controller 13 to the hydraulic circuit 14, so that the first traveling motor 3 is rotated at speed proportional to the electric signal having a magnitude corresponding to the absolute value of the fifth command value.

Also, the controller 13 calculates a sixth command value required for operation of the second traveling motor 4. Here, the controller 13 selects, as the sixth command value, one of the second command value and the fourth command value. Since the second command value and the fourth command value are all values enabling the second traveling motor 4 to rotate in the forward direction, the controller 13 selects, as the sixth command value, a relatively larger command value of the second command value and the fourth command value.

Then, the controller 13 transmits the fifth command value and the sixth command value to the hydraulic circuit 14, thereby operating the first traveling motor 3 and the second traveling motor 4.

As described above, when the first electric traveling pedal 11*a* and the second electric traveling pedal 11*b* are manipulated at the same time, the fifth command value and the sixth command value required for operations of the first traveling motor 3 and the second traveling motor 4 are determined in the above-described manner by the controller 13. Therefore, when the manipulation values of the first electric traveling pedal 11*a* and the second electric traveling pedal 11*b* are changed, the left and right turning speeds of the excavator can be adjusted. That is, when the first electric traveling pedal 11*a* and the second electric traveling pedal 11*b* are manipulated at the same time, a relative turning speed can be increased or decreased, as compared to the left turn or right turn of the excavator in accordance with the third command value and the fourth command value as a result of the single manipulation on the second electric traveling pedal 11*b*.

Although the present invention has been described with reference to the specific embodiments and the drawings, the present invention is not limited to the embodiments, and a variety of variations and modifications can be made by one skilled in the art of the present invention.

Therefore, the scope of the present invention should not be defined by the above-described embodiments but should be defined by the appended claims and equivalents thereof.

The invention claimed is:

1. A traveling control system for a construction machine comprising:

first and second electric traveling pedals configured to output manipulation values of electric signals in response to driver's manipulation and to thereby operate first and second traveling motors connected thereto, respectively;

a traveling pattern input means equipped in an operator's cab so as to enable a driver to input a traveling pattern of the construction machine;

a controller electrically connected to the first and second electric traveling pedals and the traveling pattern input means, and configured to sense the manipulation value to be output from at least one of the first and second electric traveling pedals and the traveling pattern to be input to the traveling pattern input means and to calculate and output command values required for operations of the first and second traveling motors in accordance with the input traveling pattern; and a hydraulic circuit electrically connected to the controller and configured to control a flow rate and flow of operating oil to be supplied to the first and second traveling motors in accordance with the command values to be transmitted from the controller, thereby driving the first and second traveling motors, wherein the traveling pattern comprises a first traveling pattern for moving the construction machine forward or backward in accordance with manipulation on only the first electric traveling pedal and turning the construction machine left or right in accordance with manipulation on only the second electric traveling pedal.

2. The traveling control system for a construction machine according to claim 1, wherein the controller comprises:

a memory unit configured to store a plurality of setting traveling patterns, a sensing unit configured to sense the manipulation values and the traveling pattern, and a calculation unit configured to compare the sensed traveling pattern and the plurality of setting traveling patterns and to calculate the command values to be output to the hydraulic circuit in accordance with the sensed manipulation values so that the first and second traveling motors are to be operated in accordance with a setting traveling pattern of the plurality of setting traveling patterns, wherein the setting traveling pattern coincides with the sensed traveling pattern.

3. The traveling control system for a construction machine according to claim 1, wherein the traveling pattern comprises a second traveling pattern for turning the construction machine left, or right in accordance with manipulation on only the first electric traveling pedal and moving the construction machine forward or backward in accordance with manipulation on only the second electric traveling pedal.

4. The traveling control system for a construction machine according to claim 1, wherein responsive to the controller sensing the first traveling pattern input to the traveling pattern input means and the manipulation value output from the first electric traveling pedal, the controller calculates a first command value required for the operation of the first traveling motor and a second command value required for the operation of the second traveling motor and transmits the same to the hydraulic circuit causing the construction machine to move forward or backward.

5. The traveling control system for a construction machine according to claim 4, wherein responsive to the controller sensing the first traveling pattern input to the traveling pattern input means and the manipulation value output from the second electric traveling pedal, the controller calculates a third command value required for the operation of the first traveling motor and a fourth command value required for the operation of the second traveling motor and transmits the same to the hydraulic circuit causing the construction machine to turn left or right.

6. The traveling control system for a construction machine according to claim 5, wherein responsive to the controller sensing the first traveling pattern input to the traveling pattern input means and the manipulation values output from each of the first and second electric traveling pedals, the controller calculates a fifth command value required for the operation of the first traveling motor and a sixth command value required for the operation of the second traveling motor and transmits the same to the hydraulic circuit, causing the construction machine to turn left or right, a relative turning speed thereof being increased or decreased as compared to the left turn or right turn of the construction machine in accordance with the third command value and the fourth command value.

7. The traveling control system for a construction machine according to claim 6, wherein the fifth command value is a sum of the first command value and the third command value.

8. The traveling control system for a construction machine according to claim 7, wherein when the sum of the first command value and the third command value is a positive value, the first traveling motor rotates in a forward direction, and when the sum is a negative value, the first traveling motor rotates in a reverse direction.

9. The traveling control system for a construction machine according to claim 8, wherein an electric signal having a magnitude corresponding to an absolute value of the fifth command value is transmitted from the controller to the hydraulic circuit.

10. The traveling control system for a construction machine according to claim 6, wherein as the sixth command value, a relatively larger command value of the second command value and the fourth command value is selected.

* * * * *